US007385478B2

(12) United States Patent
Martin et al.

(10) Patent No.: US 7,385,478 B2
(45) Date of Patent: Jun. 10, 2008

(54) METHOD AND SYSTEM OF AUTOMATICALLY GENERATING GLOBAL DIAGNOSTIC STATISTICS FOR A PLURALITY OF MONITORING RECEIVERS AT A MASTER RECEIVER

(75) Inventors: Christopher D. Martin, Plainview, NY (US); Narine Boodoosingh, Ozone Park, NY (US)

(73) Assignee: Honeywell International Inc., Morristown, NJ (US)

( * ) Notice: Subject to any disclaimer, the term of this patent is extended or adjusted under 35 U.S.C. 154(b) by 232 days.

(21) Appl. No.: 11/280,638

(22) Filed: Nov. 16, 2005

(65) Prior Publication Data

US 2008/0084279 A1 Apr. 10, 2008

(51) Int. Cl.
*G09F 25/00* (2006.01)

(52) U.S. Cl. ..... 340/286.01; 340/3.1; 340/506

(58) Field of Classification Search ..... 340/286.01, 340/506, 521, 522, 3.1, 3.43, 3.44; 710/110; 714/47

See application file for complete search history.

(56) References Cited

U.S. PATENT DOCUMENTS

| | | | | |
|---|---|---|---|---|
| 5,721,737 | A * | 2/1998 | Radjabi et al. | 340/3.1 |
| 6,487,375 | B2 * | 11/2002 | Ferrer et al. | 340/3.44 |
| 6,504,847 | B1 * | 1/2003 | Horlander | 340/3.1 |
| 6,853,292 | B1 * | 2/2005 | Kramer et al. | 340/3.43 |
| 7,079,020 | B2 * | 7/2006 | Stilp | 340/506 |
| 7,119,676 | B1 * | 10/2006 | Silverstrim et al. | 340/506 |

* cited by examiner

*Primary Examiner*—John Tweel, Jr.
(74) *Attorney, Agent, or Firm*—Scully, Scott, Murphy & Presser, P.C.

(57) ABSTRACT

A monitoring system apparatus used for monitoring a plurality of diagnostic statistics for a plurality of monitoring receivers. All of the monitoring receivers can be linked together. Each monitoring receiver can be programmed to transmit at least one diagnostic statistic to a selected master receiver at a fixed or variable schedule. The master receiver will generate a report according to the pre-programmed parameters. The report can be printed on a printer or sent to at least one computer that is connected to the master receiver.

20 Claims, 7 Drawing Sheets

METHOD AND SYSTEM OF AUTOMATICALLY GENERATING GLOBAL DIAGNOSTIC STATISTICS FOR A PLURALITY OF MONITORING RECEIVERS AT A MASTER RECEIVER

BACKGROUND OF THE INVENTION

1. Field of Invention

The invention relates generally to a monitoring system including a central monitoring station having a plurality of receivers that receive information from a number of different security systems at different locations wherein the receivers are connected to an automation system and at least one printer. More particularly, the invention relates to a monitoring system receiver being operably coupled to a plurality of receivers using a serial port connection such that all of the receivers that are operably coupled can generate and transmit diagnostic statistics to one master receiver for transmission to an automation system and printer.

2. Background

Security systems, such as for homes and businesses, have become commonplace as people seek to protect themselves and their property. The security system typically includes a central monitoring station that is in communication with a plurality of local security systems that are located at a home or business.

The central monitoring station is staffed with operators to monitor incoming communications and to determine when one or more of the monitored local security systems communicate an alarm. Upon receipt of an alarm, alert or an alarming event, an operator contacts emergency services such as fire or police personnel in the appropriate municipality by telephone to report the alarm.

In response to a received message, the central monitoring station processes the message and performs the necessary response. The messages from the respective security systems may include identifiers that identify the security systems.

The central monitoring station includes receivers and transmitters for communicating with different security systems via one or more networks. The receivers receive messages via a communication link from the local individual security system. Each receiver is connected to an automation system. The automation system is typically an automation computer that is programmed with control and processing instructions. The receivers are connected to the automation computer by an automation computer port. Additionally, each receiver is connected to a printer such that the data the receiver receives can be printed for the operator. Each receiver is connected to its printer via a printer port and a printer cable.

Each receiver generates diagnostic statistics regarding its operation. For example, a receiver will generate line card usage statistics such as number of calls, number of bad calls, type of alert, etc.

Currently, each receiver transmits the diagnostic statistics to its own printer and automation system using its own serial port. Therefore, there is a need for a printer to be attached to each receiver.

However, there is a need for a central monitoring station to have a means to reduce the hardwire and peripheral devices needed at the central monitoring station. Additionally, the central monitoring station operator needs a means to schedule the transmission and collection of at least one diagnostic statistic to a master receiver and/or printer.

BRIEF SUMMARY OF THE INVENTION

The present invention describes a solution that allows the central monitoring station operator to be able to schedule automatic downloads of diagnostic statistics from a plurality of operably coupled monitoring receivers to one master monitoring receiver and printer. This ability will allow a central station operator to identify busy call times, problem lines, and help keep the plurality of monitoring receivers and operating lines at their best performance, while also reducing the number of peripheral components at the central monitoring station.

In accordance with the present invention, a monitoring system for generating a report containing at least one diagnostic statistic from one or more of a plurality of monitoring receivers is provided. The monitoring system comprises a communication link that couples each of the receivers together. Each receiver includes a means for selecting which of a plurality of diagnostic statistics will be monitored, means for scheduling a time schedule for each of the selected diagnostic statistic for transmission to a master receiver and means for selecting a destination for a report that includes at least one diagnostic statistic. Each receiver further includes a means for selecting the mode of operation. The mode of operation is either a master receiver mode or a slave receiver mode. One of the receivers is designated as the master receiver and the remaining other receivers are designated as slave receivers. When a receiver is selected as a slave receiver, that receiver acts in a slave mode. In slave mode, each receiver transmits the selected at least one diagnostic statistic to the master receiver using the communication link. Each receiver also includes a means for programming a schedule and destination for the selected diagnostic statistic.

When a receiver is selected as the master receiver, the receiver acts in a master mode. In master mode, the receiver receives at least one diagnostic statistic from one or more of the slave receivers using the communication link, stores the at least one diagnostic statistic and generates a report that contains at least one diagnostic statistic using a generating means.

The system is capable of generating a report to several destinations. For example, the destination can be the master receiver's printer, a configuration computer or an automation system.

Each destination has its own communication protocol or format that is required for communication thereto. The means for generating a report at the master receiver further includes a means for converting the report into a configuration or format that is compatible with the protocol or predefined format of the selected destination. The predefined format can include a format that is compatible with the configuration computer and the automation system.

Also in accordance with the present invention, a receiver comprising a means for programming the receiver as a master receiver, and a receiving means for receiving at least one diagnostic statistic from at least one other receiver is provided. The receiver programmed as the master receiver further includes a memory section for storing at least one diagnostic statistic and a means for transmitting at least one diagnostic statistic to an external device. The receiver transmits the statistic at a predetermined scheduled time.

The remaining receiver or receivers is/are programmed as slave receiver(s).

The external device can be a printer, a configuration computer or an automation system where the configuration computer or automation system is coupled to the receiver using a communication port.

The configuration computer comprises a receiving means for receiving at least one diagnostic statistic, a memory section for storing at least one diagnostic statistic and a means for generating a report containing at least one diagnostic statistic.

Each external device has its own communication protocol or format that is required for communication thereto. The receiver further comprises a means for converting at least one diagnostic statistic into a diagnostic report. This report is in a configuration or format that is compatible with the protocol or predefined format of the selected destination. The predefined format can include a format that is compatible with the configuration computer and the automation system. Also, a corresponding method of generating and transmitting diagnostic statistics is provided.

BRIEF DESCRIPTION OF THE DRAWINGS

These and other features, benefits, and advantages of the present invention will become apparent by reference to the following text figures, with like features having consistent labels.

DETAILED DESCRIPTION OF THE INVENTION

Figure 1:
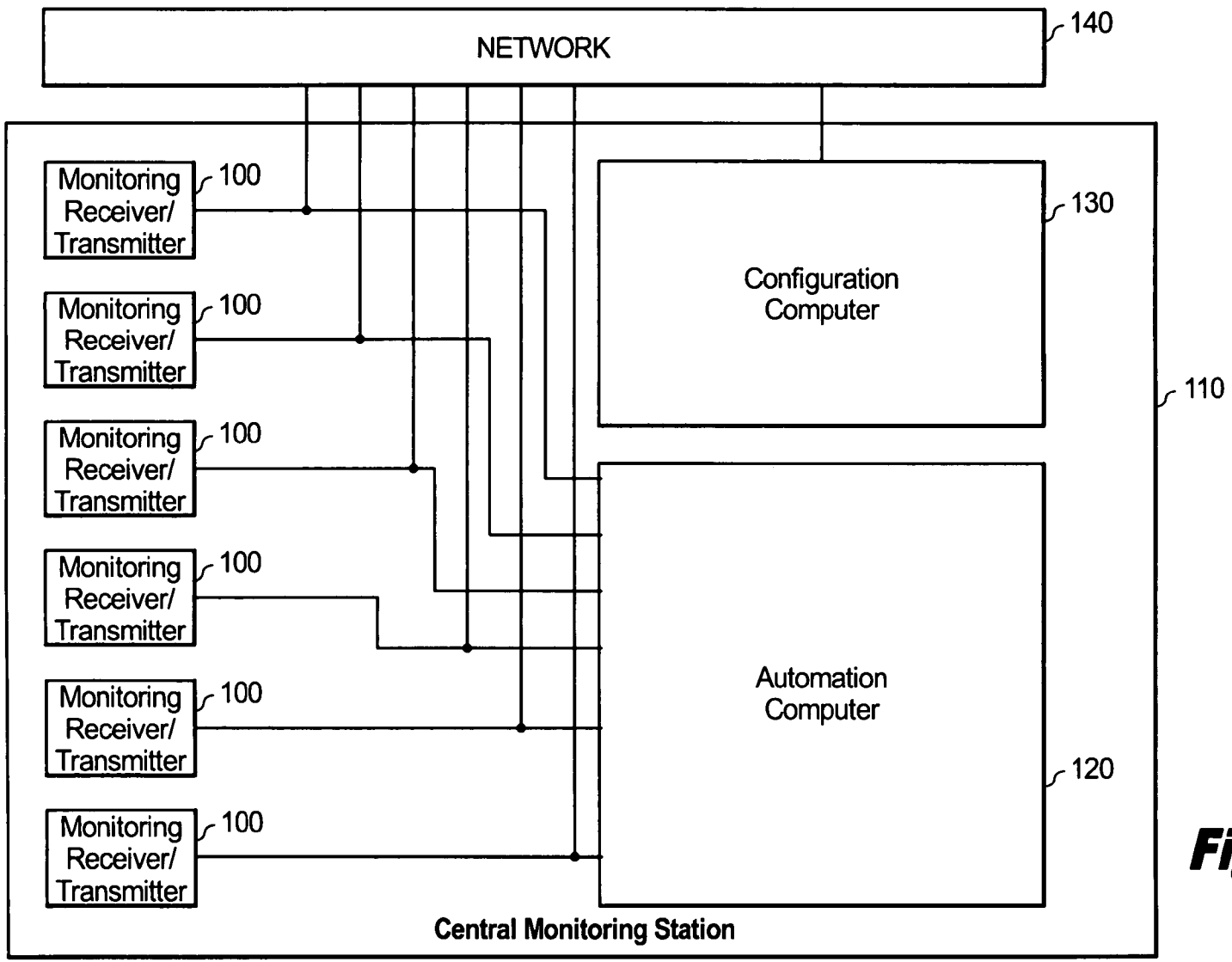
FIG. 1 illustrates a central monitoring station having a plurality of monitoring receivers.

FIG. 1 illustrates a central monitoring station 110. The central monitoring station 110 can include a configuration computer 130 that is programmed to upload and download local installed security system configurations. The central monitoring station 110 is typically provided at a staffed facility that is remote from the local installed security system which it serves. The staff at the central monitoring station 110 may monitor the alarm status of the different local security systems and take appropriate action such as notifying emergency personnel when an alarm is tripped.

The central monitoring station 110 includes a plurality of receivers and transmitters 100 for communicating with different local installed security systems via one or more networks. The plurality of receivers and transmitters 100 are connected to at least one automation computer 120. Each of the plurality of receivers 100 has its own communication path or a primary path to the automation computer 120. The receivers 100 are connected to the automation computer 120 via an automation port.

The automation computer 120 collects and processes signals received by the receiver from the local installed security system. For example, if one of the motion sensors connected to the control panel at the local installed security system is tripped; the control panel will send a signal via a communication link or network 140 to one of said plurality of receivers 100. This alarm signal is then sent to the automation computer 120 for processing. The user at the central monitoring station 110 monitors the automation computer 120 and coordinates the proper response.

The configuration computer 130 is programmed with software to achieve the desired functionality, including instructing the plurality of receivers 100 to recover the periodically updated information and other data from the local installed security systems and to initiate transmissions to the local installed security systems.

Figure 2:
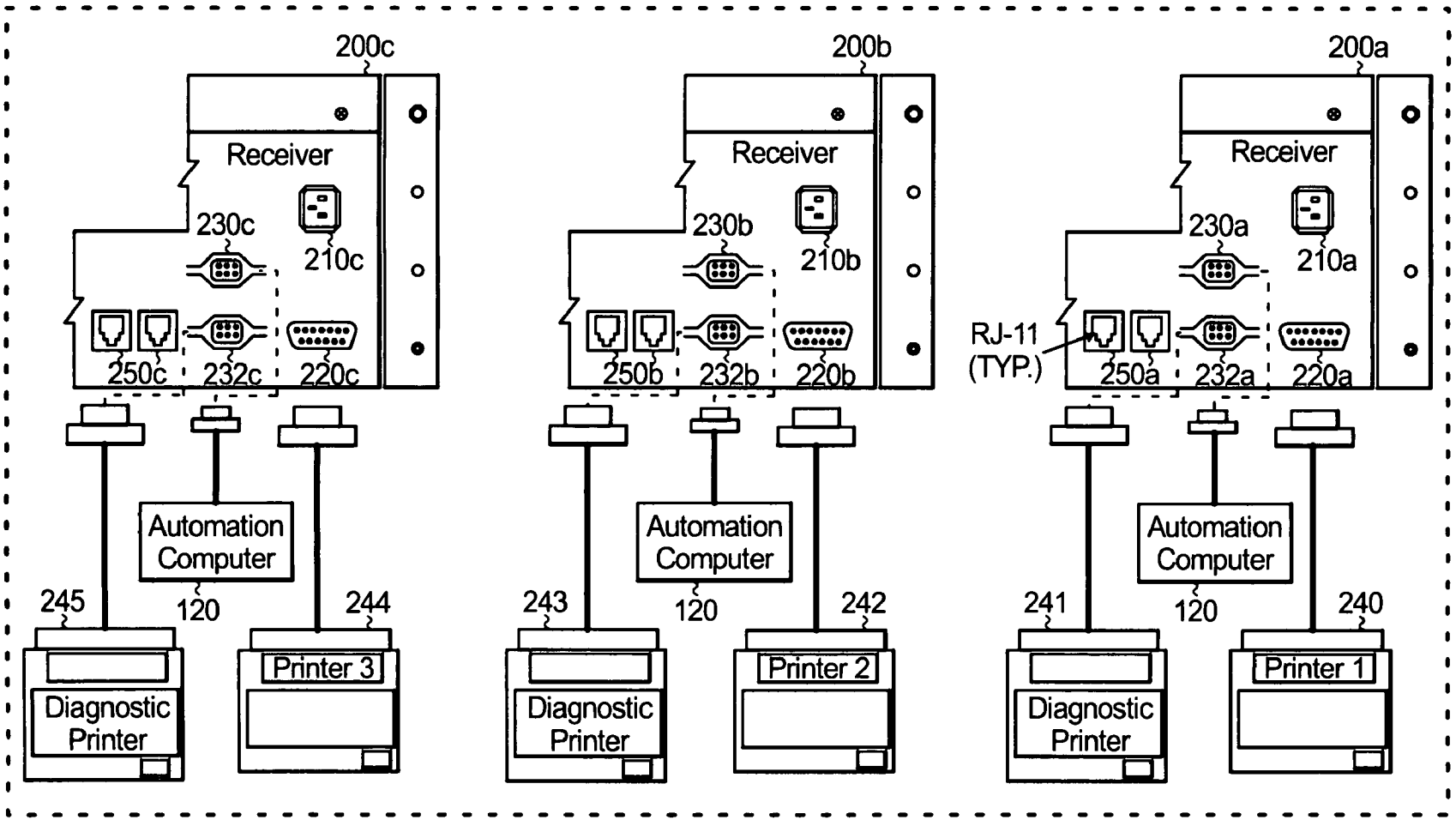
FIG. 2 illustrates an example of three receivers operating with all of the receivers transmitting diagnostic statistics to its own printer using its serial port connection.

FIG. 2 illustrates an example of a plurality of receivers with all of the receivers transmitting diagnostic statistics to their own printer and configuration system. The receiver configuration shown in FIG. 2 depicts three receivers, however, the central monitoring station is not limited to only three receivers.

In FIG. 2 each receiver 200*a*, 200*b*, 200*c*, includes a power source input port 210*a*, 210*b*, 210*c* for receiving a power source. Each receiver 200*a*, 200*b*, 200*c* further includes a printer port 220*a*, 220*b*, 220*c* for connecting to each printer 240, 242 and 244 as depicted in FIG. 2 and at least one automation port 230*a*, 230*b*, 230*c* for connecting to the automation computer 120. Receivers 200*a*, 200*b*, 200*c*, shown in FIG. 2, have two automation ports 230*a*, 232*a*, 230*b*, 232*b* and 230*c*, 232*c*, respectively; however, the receivers 200*a*, 200*b*, and 200*c* can hold more or less automation ports.

Additionally each receiver 200*a*, 200*b*, 200*c* contains a pair of serial communication ports 250*a*, 250*b*, 250*c*.

Each receiver of FIG. 2 maintains, collects and stores a plurality of diagnostic statistics regarding the receiver. After a specified default time has elapsed, each receiver will send the collected plurality of diagnostic statistics to its printer 240, 242 and 244 through its printer port 220*a*, 220*b*, 220*c*, respectively.

Alternatively, each receiver 200*a*, 200*b*, and 200*c* can have a dedicated printer 241, 243, 245 for printing a report of the diagnostic statistic. Furthermore, each receiver 200*a*, 200*b*, and 200*c* can be coupled to a computer specifically dedicated for collecting data.

However, this method is a waste of resources requiring a plurality of printers and cables that are not necessary.

Figure 3:
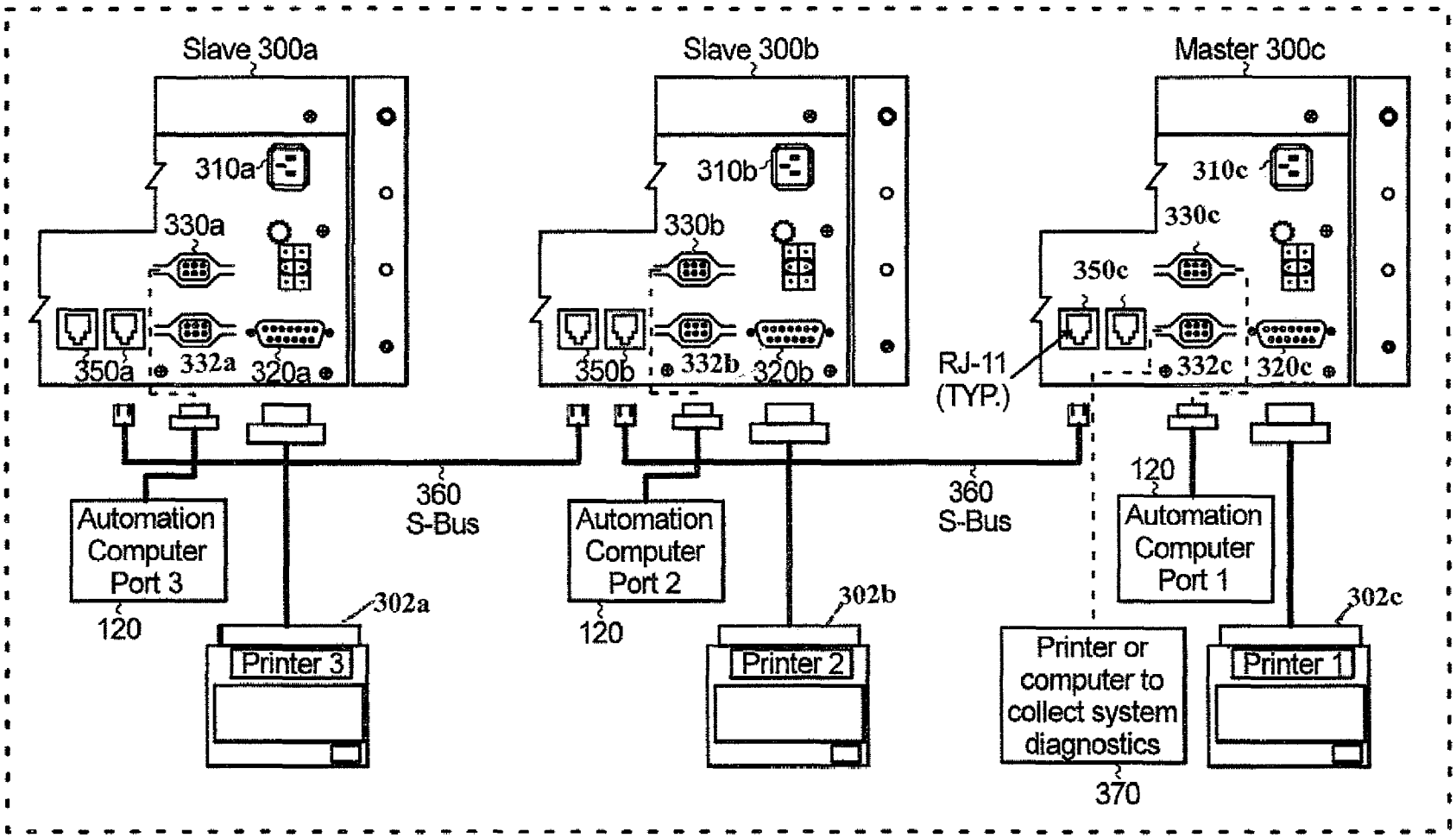
FIG. 3 illustrates a plurality of receivers operating according to the invention by transmitting diagnostic statistics to a master receiver and collecting diagnostic statistics at the master receiver.

FIG. 3 illustrates a plurality of receivers operating according to an illustrative embodiment of the invention by transmitting diagnostic statistics to a master receiver and collecting diagnostic statistics at the master receiver.

In FIG. 3 each receiver 300*a*, 300*b*, 300*c* includes a power source input port 310*a*, 310*b*, 310*c* for receiving a power source. Each receiver 300*a*, 300*b*, 300*c* further includes a printer port 320*a*, 320*b*, 320*c* for connecting to each printer 302*a*, 302*b* and 302*c* as depicted in FIG. 3 and at least one automation port 330*a*, 330*b*, 330*c* that is used to connect the automation computer 120 to the receiver. Receivers 300*a*, 300*b*, 300*c* shown in FIG. 3 have two automation ports 330*a*, 332*a*, 330*b*, 332*b* and 330*c*, 332*c*, respectively; however, the receivers 300*a*, 300*b* and 300*c* can hold more or less automation ports.

Additionally each receiver 300*a*, 300*b*, 300*c* contains a pair of serial communication ports 350*a*, 350*b*, 350*c*. Each receiver 300*a*, 300*b*, 300*c* is connected to each other's receiver by one of the pair of communication ports 350*a*, 350*b*, 350*c* using a connection means 360. In FIG. 3 the communication ports are two S-Bus ports; however, any communication port can be used with the invention.

According to an embodiment of the invention, the diagnostic statistics from each receiver 300*a*, 300*b*, 300*c* is transmitted to a master receiver via the serial ports 350*a*, 350*b*, and 350*c* to allow for the diagnostic statistics to be regularly downloaded to one receiver's port which may then be connected to a single printer or computer 370 such that the diagnostic statistics can be printed or stored in the computer's memory. Accordingly, the diagnostic statistics will be available for review by the user. Alternatively, the diagnostic statistic can be printed on the master receiver's printer 302*c*.

The serial ports 350*a*, 350*b*, and 350*c* on each receiver 300*a*, 300*b*, and 300*c* can be used to link a plurality of receivers to output to one automation computer and/or printer depending on a Master/Slave Configuration. When this Master/Slave Configuration is used, one receiver is configured as a master receiver and the remaining receivers are configured to be slaves. This linking feature will decrease the number of serial ports required for automation and/or the quantity of printers used for automation backup. In using the Master/Slave Configuration, if an automation computer goes down, the information normally sent to the automation computer or configuration computer or the like will be sent to its backup, as configured according to the method disclosed in U.S. patent application Ser. No. 11/089,766, filed on Mar. 25, 2005, entitled "METHOD AND SYSTEM OF RE-DIRECTING AND BACKING UP SECURITY SYSTEM DATA AT A RECEIVER" naming Christopher Martin as the inventor. U.S. patent application Ser. No. 11/089,766 and the instant application are assigned to the same assignee. The subject matter thereof is hereby incorporated by reference.

To use the Master/slave receiver linking, the receivers 300*a*, 300*b*, and 300*c* must be connected using the serial communication ports 350*a*, 350*b*, 350*c*.

In order to accomplish this, the operator must configure the plurality of receivers to recognize a master receiver as the "master receiver" and the remaining receivers as the "plurality of slave receivers". The receivers 300*a*, 300*b*, 300*c* can be programmed for master/slave linking to report to an automation computer and/or printer.

Figure 3A:
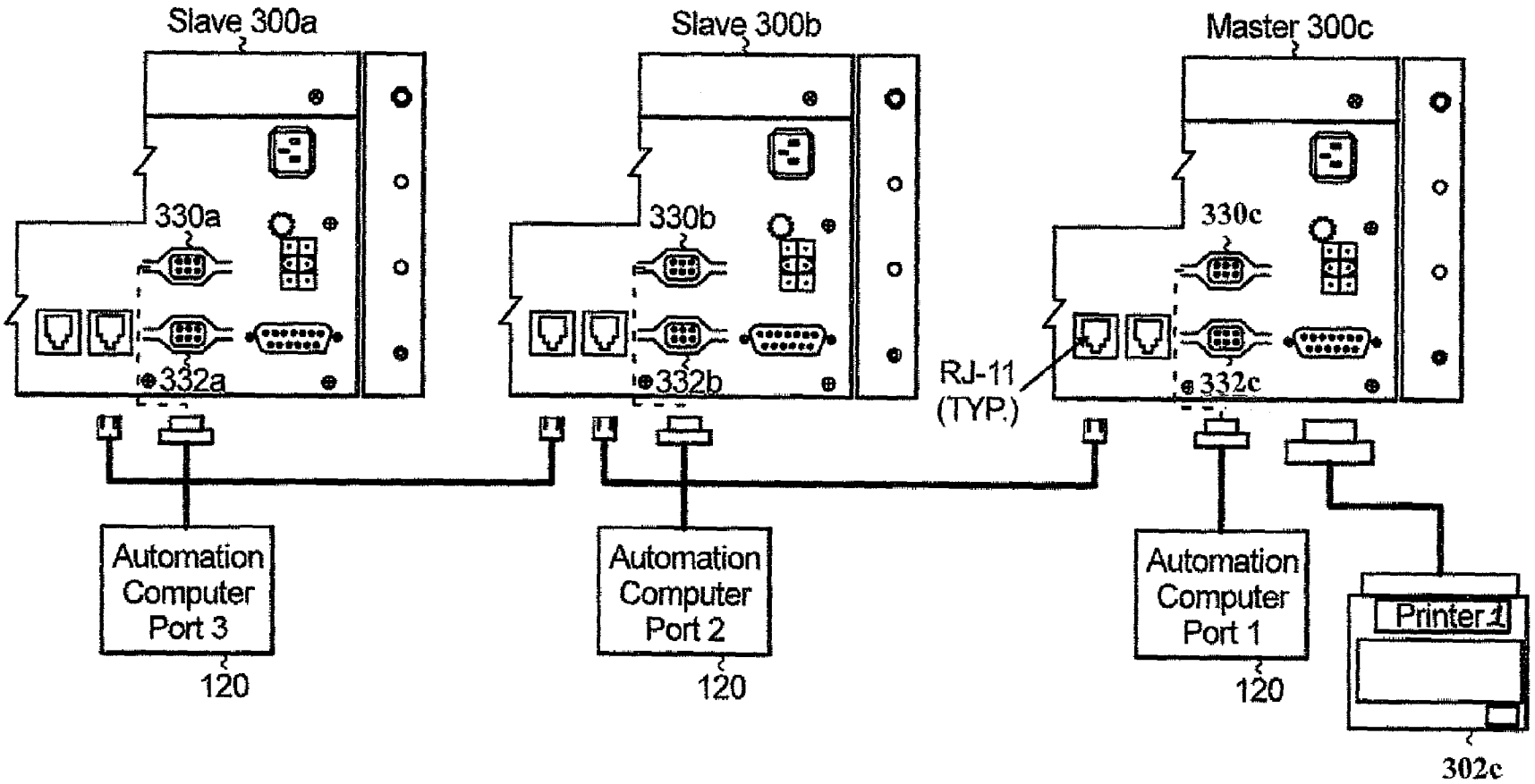
FIG. 3*a* is an example of three receivers operating in a master/slave configuration for printer operation.

FIG. 3*a* is an example of three receivers operating in a master/slave configuration for printer operation. All of the information is transmitted to the master receiver and printed on its printer. In FIG. 3*a* the master receiver is receiver 300*c*, and two slave receivers are receivers 300*a* and 300*b*. In FIG. 3*a*, each receiver 300*a*, 300*b*, and 300*c* is transmitting information to the automation computer 120 through its own automation port 330*a*, 332*a*; 330*b*, 332*b*; and 330*c*, 332*c*. However, all of the receivers 300*a*, 300*b*, and 300*c* are printing to printer 302 attached to the master receiver 300*c*.

Figure 3B:
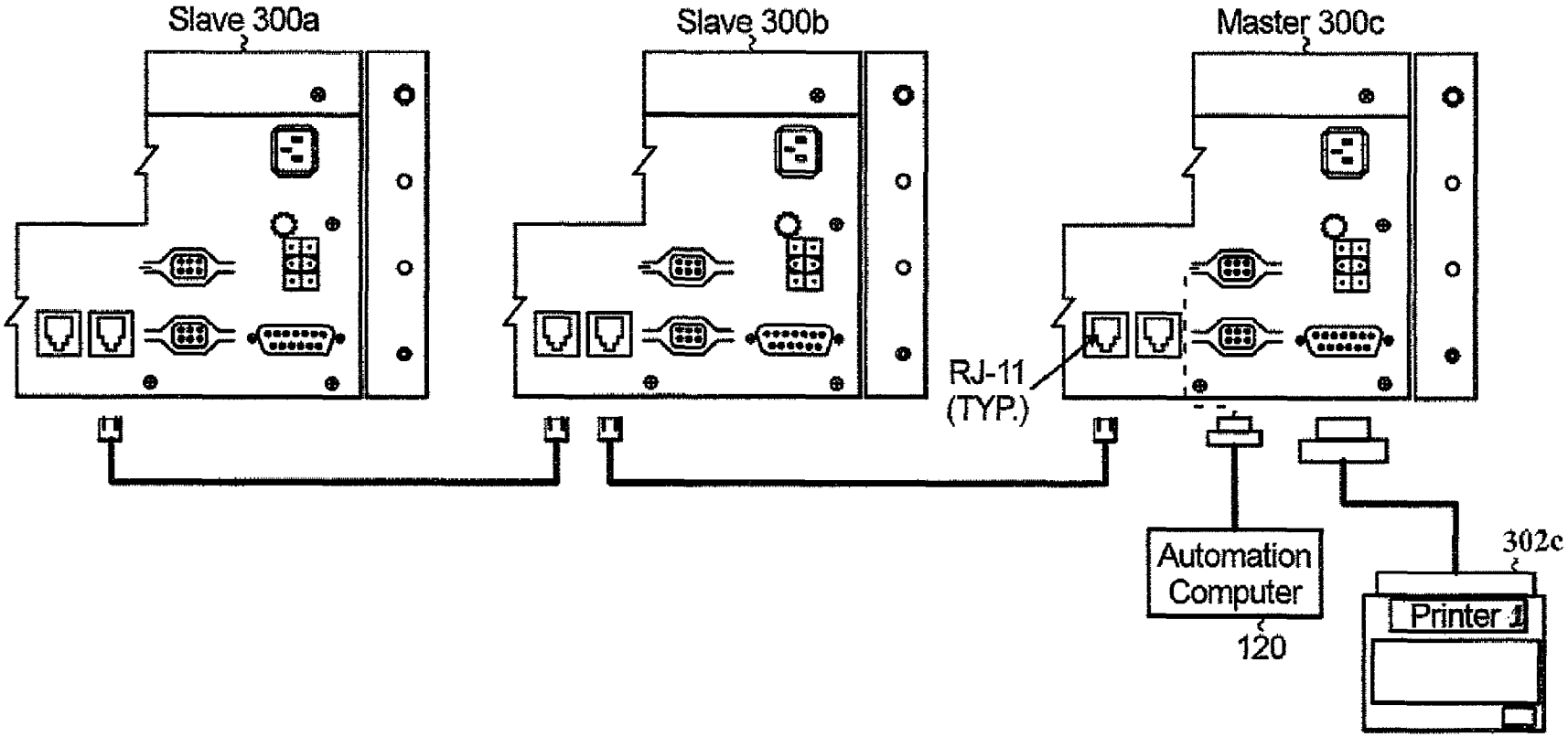
FIG. 3*b* is an example of three receivers operating in a master/slave configuration for both automation and printer operation.

FIG. 3*b* is an example of three receivers operating in a master/slave configuration for both automation and printer operation. All of the information is transmitted to the master receiver and printed on its printer. In FIG. 3*b* the master receiver is receiver 300*c*, and two slave receivers are receivers 300*a* and 300*b*. In FIG. 3*b* all of the information is sent to the automation computer 120.

Figure 4:
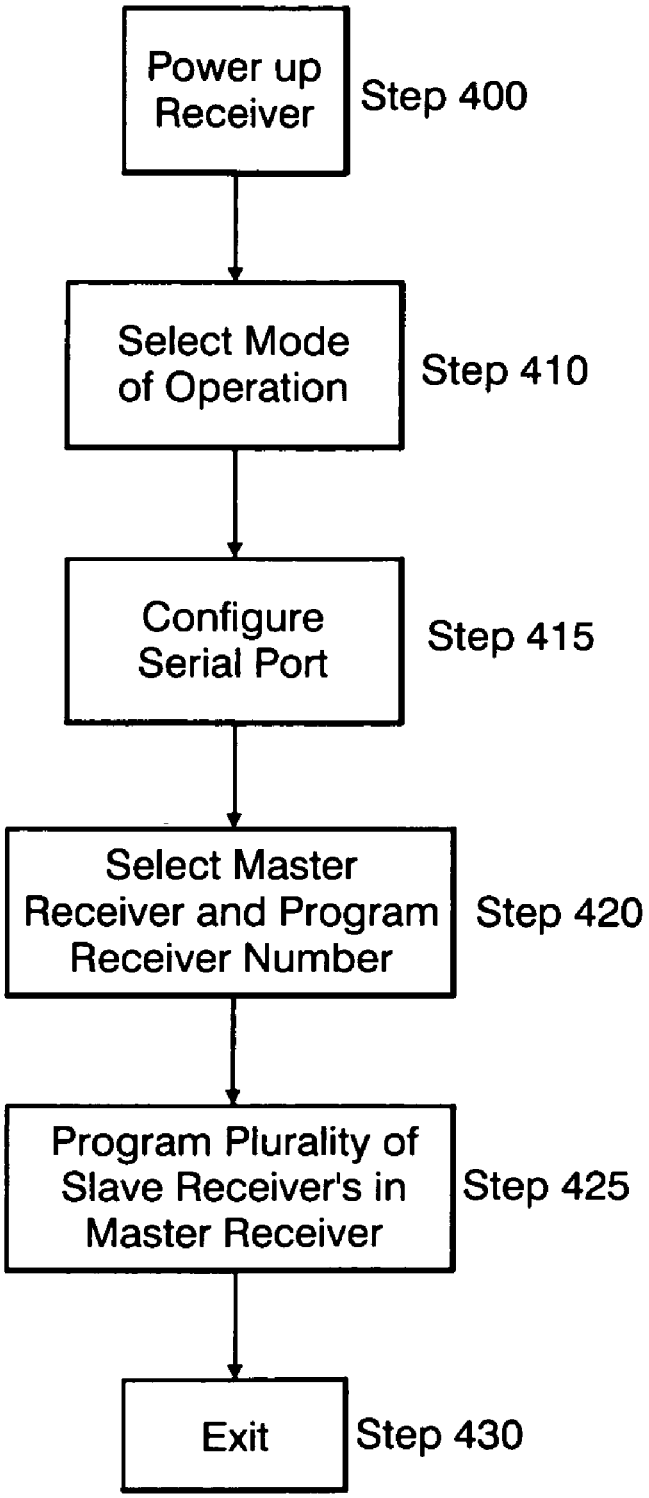
FIG. 4 illustrates an illustrative method of programming and configuring the master receiver.

FIG. 4 illustrates a method of programming and configuring the master receiver. The method begins at step 400, powering up the receiver to allow for the plurality of line cards to be initialized.

To manually configure the receiver 100, the central monitoring station operator will use the user interface means to navigate through a menu tree. The receiver has several menu options listed in the general options menu.

The operator will select a corresponding mode of operation from the general options, at step S410. For example, the option menu would read "operation mode" or "master/slave mode". To select this option the operator will depress the enter button on the user interface means.

The operator will then select a port function and configure the serial port for automation, at step 415. The operator will then be prompted to configure a "back-up port." This can be done using the method disclosed in U.S. patent application Ser. No. 11/089,766, filed on Mar. 25, 2005. The subject matter thereof is hereby incorporated by reference. Next, at step 420, the operator selects "master receiver" from the menu and will have to program the receiver's unique identification number. Each receiver is given a unique identification number such that the automation system can recognize the source of specific information. The unique identification number is typically a two-digit number. The unique identification number is displayed on the receiver's display.

After the master receiver's unique identification number has been entered and stored, the operator will then program a unique identification number for the slave receivers into the master receiver's memory section, at step 425. A "slave list" will be displayed on the display. For each of the remaining receivers the operator will enter one unique identification number corresponding to the receiver.

Once all of the unique identification numbers have been entered, the operator will exit the programming mode and cycle the power on the master receiver for the new settings to take effect, at step 430.

Once the master receiver is set, the operator must set the other receivers as the slave receivers.

Figure 5:
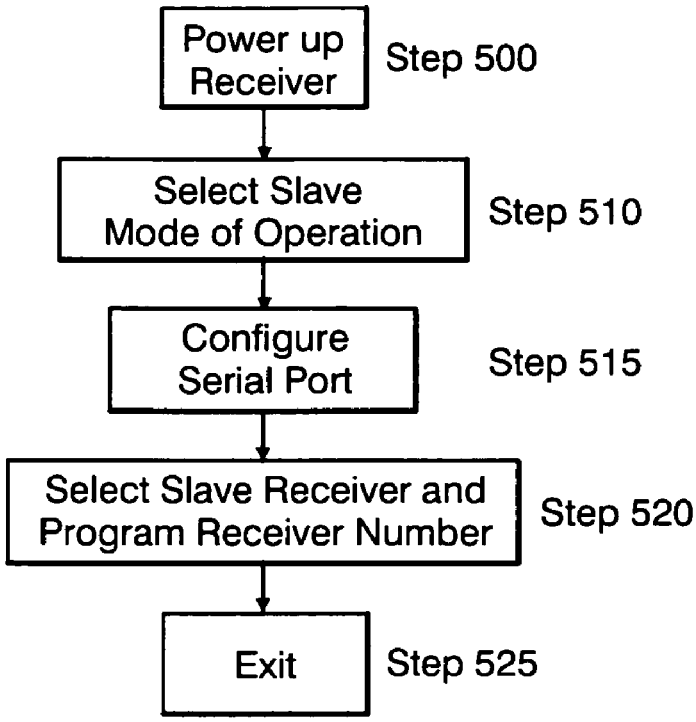
FIG. 5 illustrates an illustrative method of programming each slave receiver.

FIG. 5 illustrates the method of programming each slave receiver. The method begins at step 500, powering up the receiver to allow for the plurality of line cards to be initialized.

To manually configure the receiver, the central monitoring station operator will use the user interface means to navigate through a menu tree. The receiver has several menu options listed in the general options menu.

The operator will select a corresponding mode of operation from the general options, at step S510. For example, the option menu would read "operation mode" or "master/slave mode". To select this option the operator will depress the enter button on the user interface means.

The operator will then select a port function and configure the serial port for automation, at step 515. The operator will then be prompted to configure a "back-up port." This can be done using the method disclosed in U.S. patent application Ser. No. 11/089,766, filed on Mar. 25, 2005. Next, at step 520, the operator selects "slave receiver" from the menu and will have to program the receiver's unique identification number matching the selected master receiver. The unique identification number is displayed on the receiver's display.

Once the unique identification number has been entered, the operator will exit the programming mode and cycle the power on the master receiver for the new settings to take effect, at step 525.

Steps 500-525 will be repeated for each of the remaining receivers, i.e., non-master receivers.

As mentioned above, the receivers 300*a*, 300*b*, and 300*c* can be configured to operate in a master/slave configuration for either automation and printer operation or just printer operation. Therefore, during the configuration process the operator can select either MstrPrn for master printing, SlvPrn for slave printing or MstrAuto for both master printing and automation, SlvAuto for both slave printing and automation.

Once the receivers (300*a*, 300*b*, 300*c*) have been configured to operate in master/slave mode, the operator then can program a schedule to automatically generate and download diagnostic statistical data to the master receiver's printer. In the above example, printer 302*c* would be used. In order to create a schedule to automatically download diagnostic statistical data, the monitoring receiver will need to be programmed with software updates that will enable the monitoring receiver 100 to be configured.

Software updates containing program codes for configuring the monitoring receiver to perform the desired functions can be downloaded via the serial port 255 from a computer that is connected to the central monitoring receiver 100. It is further contemplated that the software updates can be downloaded from the security system receiver configuration computer 130. The configuration computer 130 is typically located at the central monitoring station 110. The monitoring receiver 100 is connected to the security system receiver configuration computer 130 by a connection link or Internet. It is further envisioned that the software can be preinstalled into the monitoring receiver 100 during manufacture.

Once the software is installed into the central monitoring receiver 100, each monitoring receiver 100 must be programmed to download or transmit at least one diagnostic statistical parameter to the master receiver.

Figure 6:
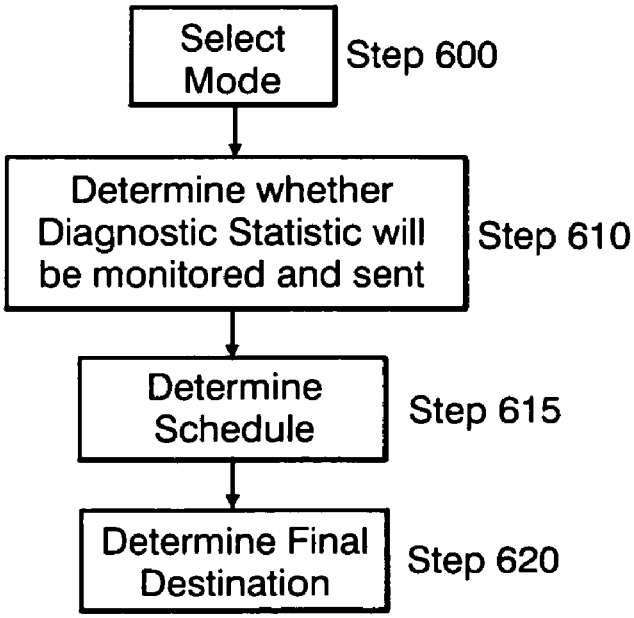
FIG. 6 illustrates the method of programming a receiver to schedule the generation and downloading of a plurality of diagnostic parameters to the master receiver.

FIG. 6 illustrates the method of programming a receiver to schedule the generation and downloading of a plurality of diagnostic parameters to the master receiver.

To manually configure the central monitoring receiver 100, the central monitoring station operator will use the user interface means 210 to navigate through a menu tree. The receiver has several menu options listed in the general options menu.

The operator will select notification message mode from the general options, at step S600. For example, the option menu would read "diagnostic" or "schedule".

The operator will generate Master Diagnostic Schedule Table that can be programmed into the monitoring receiver 100. This Message Schedule and Priority Table can include time, destination, and diagnostic statistic formats for each parameter.

However, the Master Diagnostic Schedule Table is not limited to the above-identified examples. The Master Diagnostic Schedule Table will be used by the monitoring receiver 100 to determine where, when, and how to send at least one diagnostic parameter. Specifically, the table will allow the operator to select a particular diagnostic parameter and determine a schedule, receiving location, and receiving format. Thus, the operator can identify busy call times, problem lines, busy receivers, and allow for efficient management of the operating receivers and lines.

The Master Diagnostic Schedule Table will include a list of a plurality of diagnostic parameters, each of which can be programmed to be downloaded or transmitted to the master receiver. Diagnostic parameters or statistics can include call history, system history, Line Card Statistics, Event Log and Message Que.

Call history includes statistics and parameters regarding Life safety signals, like fire and duress; property safety signals, like a burglary at home or business; a supervisory signal, trouble signals, and other types of call signals.

The call history will include an account number, a unique receiver number, line number, reason for the call, zone number that relates to a call and the timing of the event such as month, day, year and the exact time.

A system history includes an event that is related to the receiver operation such as line card faults, low backup battery, AC power loss, log in, log out, and communication failure to a printer or automation system.

Line Card Statistics include print card statistics that contain a receiver number, part number, line number, total calls for the line, calls for a predetermined time period, and number of bad calls for the line.

The Message Que is an indication of how full the message queue is. The Message Que can be a percentage of the total memory available for a message.

For each of the plurality of diagnostic statistics, the operator will determine whether such statistic will be transmitted to the master receiver and ultimately to the master receiver's printer 302*c* and/or dedicated computer 370 (step 610). Once the operator determines that the diagnostic statistic will be enabled for transmission, the operator will determine a schedule for the transmission, at step 615. A schedule could be every hour, day, week, etc. Each receiver has an internal clock that will generate a time signal which will be used for keeping track of the schedule.

Next, the operator can program the final destination for selected diagnostic statistics, at step 620. In an embodiment, the diagnostic statistic can be transmitted to the master receiver from the other slave receiver. This diagnostic statistic then can be transmitted either as raw data or as a formatted report to the master receiver's printer 302*c*. Alternatively, the system can include a dedicated printer or computer 370 to collect and store the raw data and/or formatted report. For example, the dedicated computer 370 can be the configuration computer. The configuration computer can be programmed to accept and store the raw diagnostic statistics. Additionally, the configuration computer can be programmed to generate at least one report containing the raw diagnostic. In this configuration, the master receiver will transmit the raw data to the configuration computer. The master receiver will act as an intermediary between the slave receivers and the configuration computer.

In the illustrated embodiment, the diagnostic statistics are stored in the master receiver's memory long enough for the receiver to generate a report containing the diagnostic statistics.

However, in another embodiment, the diagnostic statistics can be both printed by the master receiver's printer 302*c* and stored in the memory of the master receiver for transmission to an external computer.

In yet another embodiment, the diagnostic statistics can be transmitted from the master receiver to the automation computer using the serial port 330C. However, in this embodiment, an additional programming step is necessary. The diagnostic statistics will have to be configured to be compatible with the automation security system protocol. This configuration will be automatically performed by software that is installed in the master receiver. By transmitting the diagnostic statistics to the automation computer 120 using an automation security system protocol, any operator will be able to view the diagnostic data from their computer station without having to go to a dedicated printer or machine.

In another embodiment of the invention, the Master Diagnostic Schedule Table parameters and other control information can be entered using the configuration computer 130.

It is also within the scope of the invention to input all of the configuration parameters for the Master Diagnostic Schedule Table for the plurality of slave receivers by manually inputting them using master receiver. This would be done by first inputting the unique identifier corresponding to the slave receiver, i.e., 300*a* and 300*b*. The display on the master receiver 300*c* would then display a screen that would allow the operator to input the parameters, as if the operator was inputting the parameters at the slave receiver (either 300*a* or 300*b*). This process would be repeated for each of the plurality of slave receivers, i.e., 300*a* and 300*b*.

The invention has been described herein with reference to particular exemplary embodiments. Certain alterations and modifications may be apparent to those skilled in the art without departing from the scope of the invention.

The exemplary embodiments are meant to be illustrative, not limiting of the scope of the invention, which is defined by the appended claims.

What is claimed is:

1. A monitoring system for generating a report containing at least one diagnostic statistic from one or more of a plurality of monitoring receivers, comprising:

a communication link connecting each of said plurality of receivers, where one of said plurality of receivers is a master receiver, and the other of said plurality of receivers are slave receivers;

each of said plurality of receivers including means for selecting which of a plurality of diagnostic statistics will be monitored, means for scheduling a time schedule for each selected diagnostic statistic for transmission of said selected diagnostic statistic to the master receiver, means for selecting a destination for said report containing at least one diagnostic statistic, and a means for selecting a mode of operation, said mode being either a master receiver mode or a slave receiver mode, when one or more receivers of said plurality of receivers is selected to operate in slave receiver mode, said one or more receivers transmit said diagnostic statistic to said master receiver via said communication link using a transmission means, when one of said plurality of receivers is selected to operate in master receiver mode, said receiver receives at least one diagnostic statistic from one or more slave receivers via said communications link, stores said at least one diagnostic statistic and generates said report containing said at least one diagnostic statistic, using a generating means.

2. The monitoring system apparatus of claim 1, wherein said destination is a master receiver's printer.

3. The monitoring system apparatus of claim 1, wherein said destination is a configuration computer.

4. The monitoring system apparatus of claim 1, wherein said destination is an automation system.

5. The monitoring system apparatus of claim 1, wherein said generating means includes a converting means for configuring said report to be in a format compatible with a predefined format for said destination.

6. The monitoring system apparatus of claim 5, wherein said predefined format is compatible with the automation system.

7. The monitoring system apparatus of claim 1, wherein the schedule and destination information for said at least one diagnostic statistic for each slave receiver is programmed at a corresponding slave receiver, and schedule and destination information at least one diagnostic statistic for said master receiver is programmed at the master receiver.

8. The monitoring system apparatus of claim 1, wherein the schedule and final destination information for said at least one diagnostic statistic for each slave receiver is programmed at the master receiver.

9. A method of monitoring diagnostic parameters for a plurality of monitoring receivers, the method comprising the steps of:

linking said plurality of receivers together to create a plurality of linked receivers;

selecting one of said plurality of linked receivers as a master receiver, and selecting the other of said plurality of linked receivers as at least one slave receiver;

at each of said plurality of linked receivers, selecting at least one diagnostic parameter for transmission to the master receiver for monitoring, as a selected group of diagnostic parameters;

programming a schedule for transmitting each diagnostic parameter of said selected group of diagnostic parameters; and programming a destination of transmission for each diagnostic parameter of said selected group of diagnostic parameters, at the master receiver, receiving said at least one selected group of diagnostic parameters;

storing said at least one selected group of diagnostic parameters; and generating a report according to said programmed schedule and destination.

10. The method according to claim 9, wherein the step of generating said report including configuring said report to be in a format compatible with a predefined format for said destination.

11. The method according to claim 10, wherein said predefined format is compatible with the automation system.

12. The method according to claim 9, wherein the schedule and destination for said at least one diagnostic statistic for each slave receiver is programmed at the master receiver.

13. The method according to claim 9, wherein said destination is a master receiver's printer.

14. The method according to claim 9, wherein said destination is a configuration computer.

15. The method according to claim 9, wherein said destination is an automation system.

16. A receiver comprising:

a means for programming said receiver as a master receiver;

receiving means for receiving at least one diagnostic statistic from at least one other receiver, where said at least one other receiver is programmed as a slave receiver;

memory section for storing said at least one diagnostic statistic; and a means for transmitting said at least one diagnostic statistic, at a predetermined scheduled time to an external device.

17. The receiver of claim 16, wherein said external device is a configuration computer that is coupled to said receiver via a communication port.

18. The receiver of claim 17, wherein said configuration computer comprises a receiving means for receiving said at least one diagnostic statistic, a memory section for storing said at least one diagnostic statistic and a means for generating a report containing said at least one diagnostic statistic.

19. The receiver of claim 16, wherein said external device is an automation computer that is coupled to said receiver via a communication port.

20. The receiver of claim 16, further comprising a means for converting said diagnostic statistic into a diagnostic report, wherein said diagnostic report is in a protocol that is compatible with a predefined format that corresponds with said external device.

* * * * *